US009772588B2

(12) United States Patent
Yamakawa

(10) Patent No.: US 9,772,588 B2
(45) Date of Patent: Sep. 26, 2017

(54) FIXING UNIT WITH ROTATING MEMBER HAVING ENGAGING HOLES THAT ENGAGE PROJECTIONS ON A HEAT INSULATING MEMBER, AND IMAGE FORMING APPARATUS THEREOF

(71) Applicant: KYOCERA Document Solutions Inc., Osaka (JP)

(72) Inventor: Tomohiko Yamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/203,471

(22) Filed: Jul. 6, 2016

(65) Prior Publication Data

US 2017/0031285 A1 Feb. 2, 2017

(30) Foreign Application Priority Data

Jul. 27, 2015 (JP) ..... 2015-147884

(51) Int. Cl.
*G03G 15/20* (2006.01)

(52) U.S. Cl.
CPC ..... *G03G 15/2057* (2013.01)

(58) Field of Classification Search
CPC ..... G03G 15/2057
USPC ..... 399/333
See application file for complete search history.

(56) References Cited

U.S. PATENT DOCUMENTS

2002/0061211 A1* 5/2002 Kamijo ..... H04N 1/00567 399/328
2009/0297180 A1* 12/2009 Kajita ..... G03G 15/2039 399/33
2012/0251208 A1* 10/2012 Hasegawa ..... G03G 15/2017 399/329
2012/0328342 A1* 12/2012 Takematsu ..... G03G 15/0189 399/333

FOREIGN PATENT DOCUMENTS

JP 08-101596 4/1996

OTHER PUBLICATIONS

"Coefficient of Thermal Expansion for Various Materials at Different Temperatures" Bal Seal Engineering. Published Jun. 2004.*

* cited by examiner

*Primary Examiner* — Walter L Lindsay, Jr.
*Assistant Examiner* — Philip Marcus T Fadul
(74) *Attorney, Agent, or Firm* — Studebaker & Brackett PC

(57) ABSTRACT

A fixing unit includes a rotating member and a heat insulating member. The rotating member is heated by a heat source and is configured to rotate around a shaft. The heat insulating member is attached at an end of the rotating member. The rotating member includes three or more engage holes perforated at intervals in a circumferential direction thereof. The heat insulating member includes three or more engaging projections fitting into the respective engage holes.

6 Claims, 8 Drawing Sheets

FIXING UNIT WITH ROTATING MEMBER HAVING ENGAGING HOLES THAT ENGAGE PROJECTIONS ON A HEAT INSULATING MEMBER, AND IMAGE FORMING APPARATUS THEREOF

INCORPORATION BY REFERENCE

This application is based on and claims the benefit of priority from Japanese Patent application No. 2015-147884 filed on Jul. 27, 2015, the entire contents of which are incorporated herein by reference.

BACKGROUND

The present disclosure relates to a fixing unit configured to fix a toner image on a recording medium and an image forming apparatus including this.

An electro-photographic image forming apparatus includes a fixing unit configured to fix a toner image on a recording medium such as a sheet of paper.

The fixing unit includes a fixing roller pair heating and fixing the toner image on a sheet. A heat-resistant bushing is disposed between a shaft and a bearing of at least one roller of the fixing roller pair. The heat-resistant bushing is provided to block the heat from being transmitted from the shaft of the roller to the bearing. The heat-resistant bushing is fixed to the shaft of the roller by a retaining ring and rotates integrally with the shaft of the roller. Because the heat-resistant bushing and the roller shaft do not slip with each other, it is possible to prevent noise from being generated by friction.

Still further, the heat-resistant bushing is configured such that thermal expansion thereof is suppressed by setting a coefficient of thermal expansion thereof to be lower than that of the roller shaft. In general, the fixing roller pair (roller shaft) is formed of metal such as iron and stainless steel to be able to sustain high temperature. Meanwhile, the heat-resistant bushing is formed of a material that does not transmit the heat from the shaft of the roller to the bearing.

However, the fixing unit described above requires the retaining ring to fix the heat-resistant bushing to the roller shaft. Therefore, it is costly to manufacture the retaining ring and it takes time and cumbersome works to attach the retaining ring. Besides that, because the heat-resistant bushing of the fixing unit described above must be formed of a material whose coefficient of thermal expansion is lower than that of the metallic roller shaft and which is capable of shutting off the heat, a considerable restriction is imposed in selecting the material.

SUMMARY

In accordance with an embodiment of the present disclosure, a fixing unit includes a rotating member and a heat insulating member. The rotating member is heated by a heat source and is configured to rotate around a shaft. The heat insulating member is attached at an end of the rotating member. The rotating member includes three or more engage holes perforated at intervals in a circumferential direction thereof. The heat insulating member includes three or more engaging projections fitting into the respective engage holes.

In accordance with an embodiment of the present disclosure, an image forming apparatus includes a fixing unit configured to fix a toner image on a recording medium. The fixing unit includes a rotating member and a heat insulating member. The rotating member is heated by a heat source and is configured to rotate around a shaft. The heat insulating member is attached at an end of the rotating member. The rotating member includes three or more engage holes perforated at intervals in a circumferential direction thereof. The heat insulating member includes three or more engaging projections fitting into the respective engage holes.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A suitable embodiment of the present disclosure will be described below with reference to the attached drawings. It is noted that the following description will be made by defining a front side of sheet surfaces of FIG. 1 as a front view and based on directions indicated in each drawing.

Figure 1:
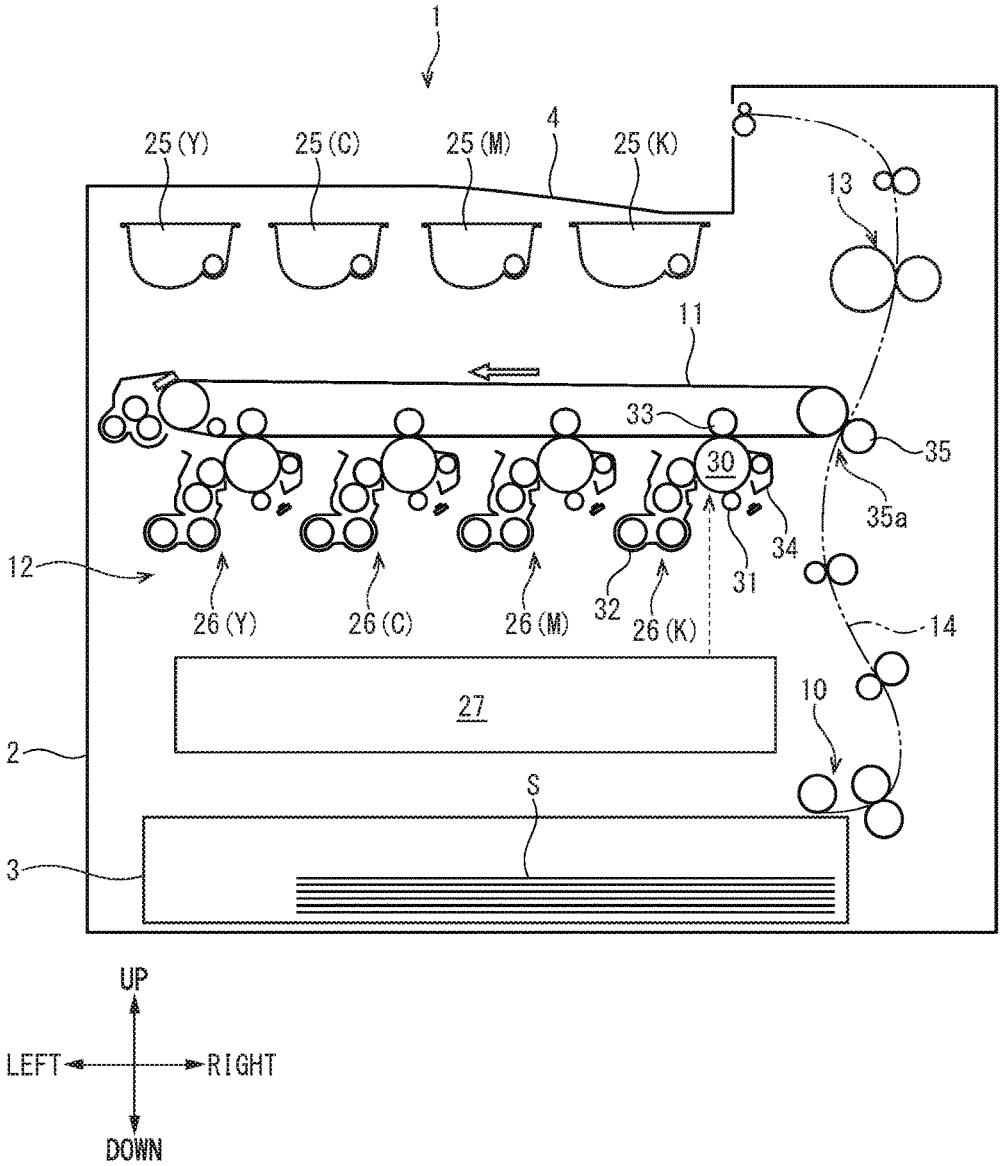
FIG. 1 is a sectional view schematically illustrating a color printer according to one embodiment of the present disclosure.

As shown in FIG. 1, the color printer 1 includes an apparatus body 2, a sheet feed cassette 3 and a discharge tray 4. The sheet feed cassette 3 is provided drawably in a lower part of the roughly box-like formed apparatus body 2. A sheet S (a recording medium) is stored in the sheet feed cassette 3. The discharge tray 4 is provided in a upper part of the apparatus body 2. It is noted that the sheet S is not limited to be a sheet of paper and may be a resin film, and the like.

The color printer 1 includes a sheet feeding part 10, an intermediate transfer belt 11, an image forming part 12 and a fixing unit 13 within the apparatus body 2. The sheet feeding part 10 is provided upstream of a conveying path 14 extended from the sheet feed cassette 3 to the discharge tray 4. The intermediate transfer belt 11 and the image forming part 12 are provided at an intermediate part of the apparatus body 2. The fixing unit 13 is provided downstream of the conveying path 14.

The image forming part 12 includes four tonner containers 25, four drum units 26 and an optical scanning device 27.

The four tonner containers 25 house toners (developing agents) of four colors (yellow, magenta, cyan, black).

Each of the drum units 26 includes a photosensitive drum 30, a charging device 31, a development device 32, a primary transferring roller 33 and a cleaning device 34. Each drum unit 26 transfers the toner image on the photosensitive drum 30 to the intermediate transfer belt 11. A secondary transfer roller 35 forming a secondary transfer nip part 35*a* is disposed on a right side of the intermediate transfer belt 11. The full-color toner image borne on the intermediate transfer belt 21 is transferred onto the sheet S passing through the secondary transfer nip part 35*a*. The fixing unit 13 fixes the toner image on the sheet S. The sheet S which has been fixed is discharged on the discharge tray 4.

Figure 2:
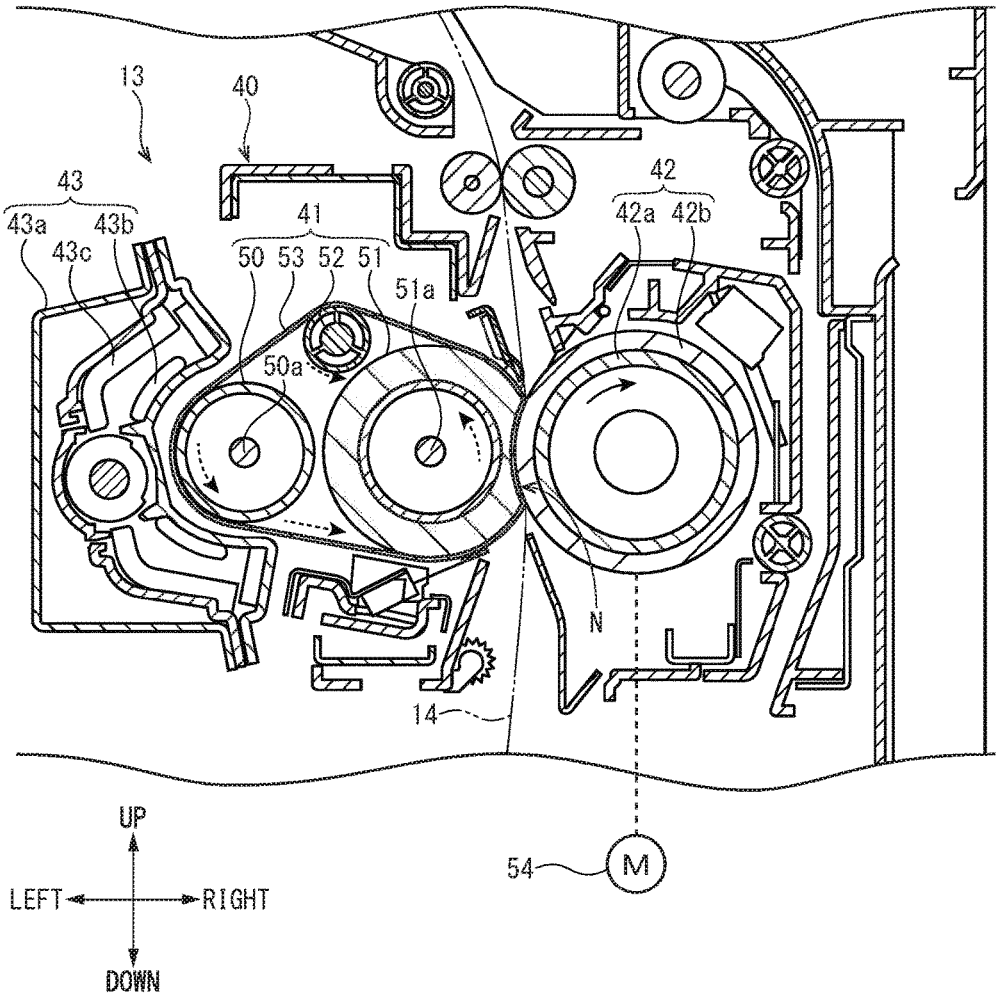
FIG. 2 is a sectional view illustrating a fixing unit according to one embodiment of the present disclosure.
Figure 3:
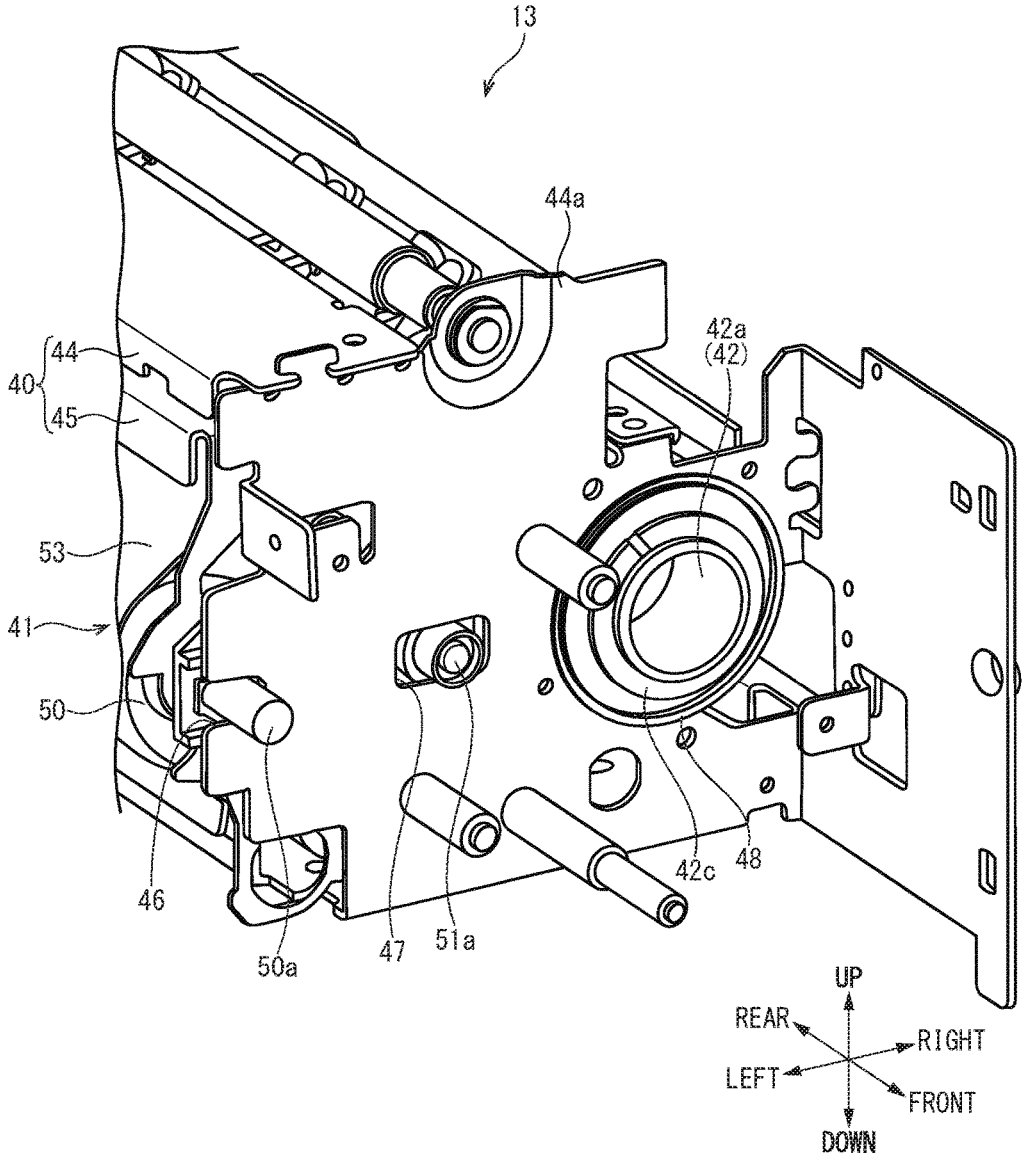
FIG. 3 is a perspective view illustrating a front side of the fixing unit according to one embodiment of the present disclosure.

Next, reference to FIGS. 2 and 3, the fixing unit 13 will be described. FIG. 2 is a sectional view illustrating the fixing unit 13. FIG. 3 is a perspective view illustrating a front side of the fixing unit 13.

As shown in FIG. 2, the fixing unit 13 includes a fixing frame 40, a belt unit 41, a pressure roller 42 and an IH (Induction Heating) unit 43.

As shown in FIG. 3, the fixing frame 40 is formed approximately into a shape of a box by a metallic material such as iron. The fixing frame 40 includes a fixed frame 44 and a movable frame 45 supported by the fixed frame 44 slidably in a left-right direction.

Both front and rear walls 44*a* of the fixed frame (FIG. 3 illustrates only the front side) are provided respectively with an engage groove 46 and an engage hole 47 perforated therethrough. Each engage groove 46 is cut from a left end of the wall 44*a* to a right direction. Each engage hole 47 is perforated through the wall 44*a* on a right side of the engage groove 46. A bearing 48 is fitted into each of the both front and rear walls 44*a*.

As shown in FIG. 2, the belt unit 41 includes a heating roller 50, a fixing roller 51, a tension roller 52 and a fixing belt 53. The rollers 50, 51, and 52 are formed approximately into a cylindrical shape extending in the front-rear direction, respectively. The fixing belt 53 is flexible and is formed to be endless.

The heating roller 50 is disposed on a left side of the fixing frame 40. Both front and rear ends of a first rotational shaft 50*a* of the heating roller 50 are pivotally supported by the respective engage grooves 46 of the fixed frame 44 (see FIG. 3).

The fixing roller 51 is disposed on a right side of the heating roller 50. Both front and rear ends of a second rotational shaft 51*a* of the fixing roller 51 are pivotally supported by the respective engage hole 47 of the fixed frame 44 (see FIG. 3).

The tension roller 52 is disposed on an upper right side of the heating roller 50 and on an upper left side of the fixing roller 51. The tension roller 52 is rotatably supported by the fixed frame 44. The tension roller 52 is urged on the upper right side by a coil spring not shown. Thereby, the fixing belt 53 is pressed on the upper right side and a certain tension is applied to the fixing belt 53.

It is noted that the heating roller 50 (the first rotational shaft 50*a*), the fixing roller 51 (the second rotational shaft 51*a*) and the tension roller 52 are formed of a metallic material such as iron, stainless steel and aluminum.

The fixing belt 53 is wrapped around the heating roller 50, the fixing roller 51, and the tension roller 52. The fixing belt 53 is supported by the movable frame 45 so as to be able to circularly travel (see FIG. 3). Although not shown, the fixing belt 53 contains an elastic layer (resin) layered on a base layer (metal or resin).

The pressure roller 42 is disposed on a right side of the fixing roller 51 across the fixing belt 53. The pressure roller 42 is brought into pressure contact with 53 (the fixing roller 51). A fixing nip N is formed between the fixing belt 53 and the pressure roller 42.

The pressure roller 42 is formed by layering an elastic layer 42*b* on a circumferential surface of a cylindrical core member 42*a*. The core member 42*a* is formed of a metallic material such as iron, stainless steel and aluminum or the like. The elastic layer 42*b* is formed of silicone rubber, silicone sponge or the like. It is noted that a releasing layer not shown and composed of a fluorine-based resin or the like is formed on a surface of the elastic layer 42*b*.

As shown in FIG. 3, both front and rear ends of the core member 42*a* are pivotally supported by the bearings 48 fitted into the fixed frame 44 through bushings 42*c*, respectively. The pressure roller 42 is connected with a driving source 54 composed of a motor or the like (see FIG. 2).

As shown in FIG. 2, the IH unit 43 is provided on a left side of the belt unit 41. The IH unit 43 includes a case member, an IH coil 43*b* and an arch core 43*c*. The IH coil 43*b* and the arch core 43*c* are stored with in the case member 43*a*. The IH coil 43*b*, i.e., a heat source, is provided in circular-arc along an outer circumference of the fixing belt 53. The arch core 43*c* is provided along an outer circumference of the IH coil 43*b*.

Here, an operation of the fixing unit 13 described above will be described. The fixing unit 13 is driven and controlled by a controller of the printer 1. By being controlled by the controller, the driving source 54 rotates the pressure roller 42 (see an arrow in FIG. 2). Along with that, the fixing belt 53 being in pressure contact with the pressure roller 42 is driven and circularly travels (see a broken line arrow in FIG. 2). Still further, along the circular travel of the fixing belt 53, the respective rollers 50, 51 and 52 are also rotationally driven (see broken line arrows in FIG. 2). The controller controls a power supply not shown to flow a high frequency current through the IH coil 43*b*. Then, due to an action of magnetic field generated by the IH coil 43*b*, the fixing belt 53 is inductively heated. When a sheet S passes through the fixing nip N in this state, the sheet S and the toner image are heated and are pressed. Thereby, the toner image is fixed onto the sheet S.

As described above, the heating roller 50, the fixing roller 51 and the tension roller 52 are formed of the metallic material to be able to sustain the high temperature. Because the heating roller 50 is disposed in a vicinity of the IH unit 43 (the IH coil 43*b*), temperature thereof is liable to be high. Then, the fixing unit 13 of the present embodiment includes a heat insulating bushing 70 blocking the heat from being transmitted from the heating roller 50 to the fixing frame 40 (the fixed frame 44).

Figure 4:
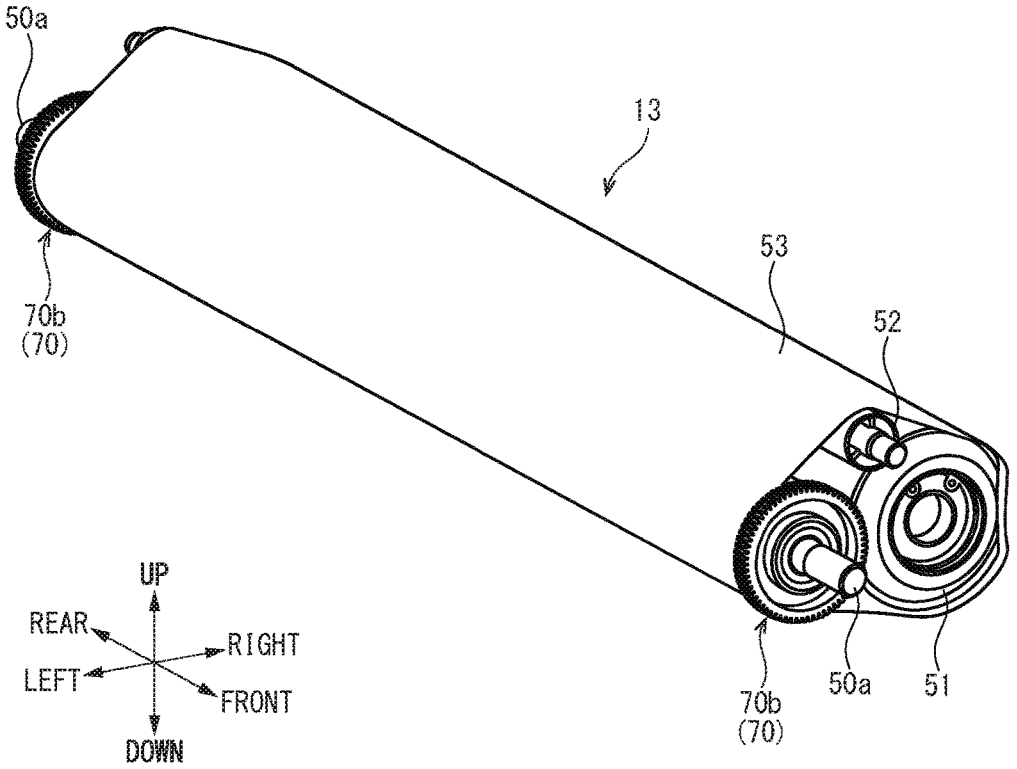
FIG. 4 is a perspective view illustrating a belt unit of the fixing unit according to one embodiment of the present disclosure.
Figure 5:
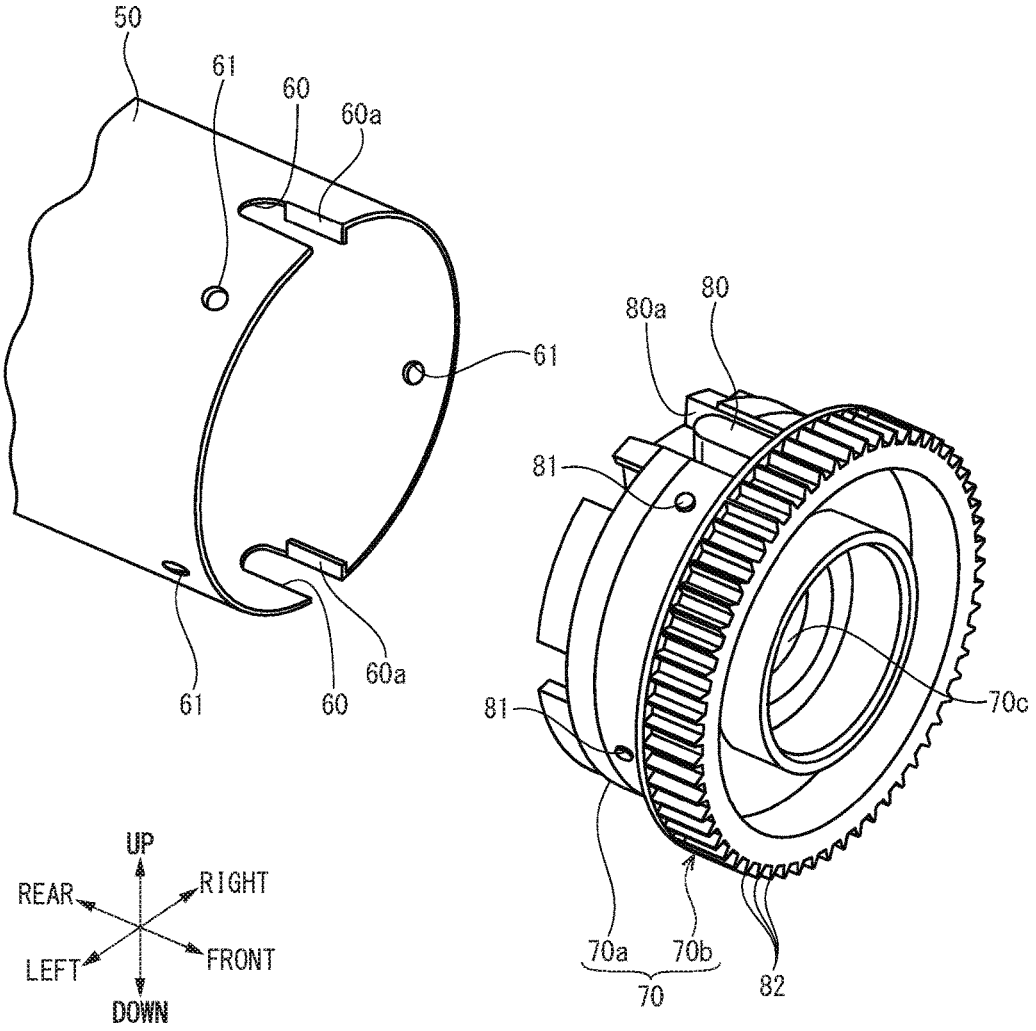
FIG. 5 is a perspective view illustrating a heating roller and a heat insulating bushing of the fixing unit according to one embodiment of the present disclosure.
Figure 6:
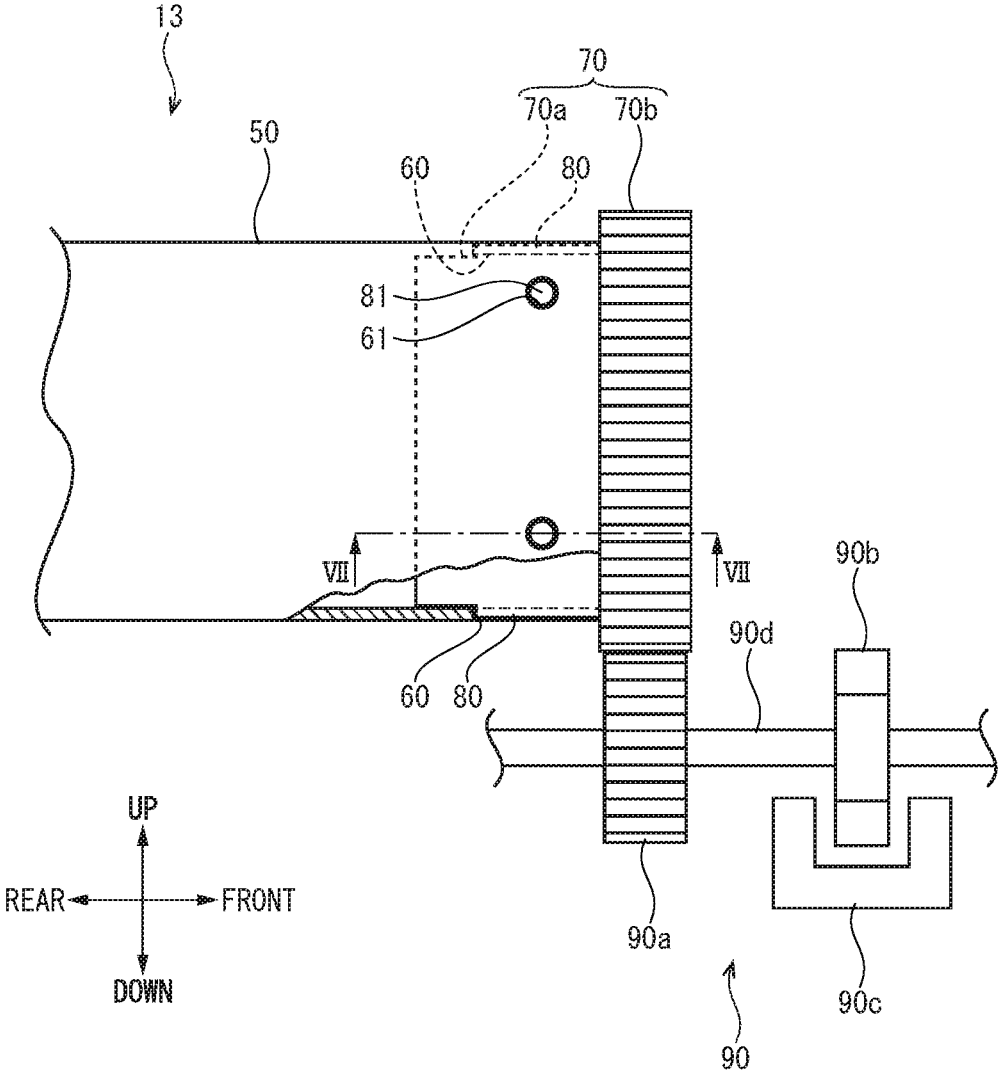
FIG. 6 is a side view illustrating the heating roller, the heat insulating bushing and a rotation detecting mechanism of the fixing unit according to one embodiment of the present disclosure.
Figure 7:
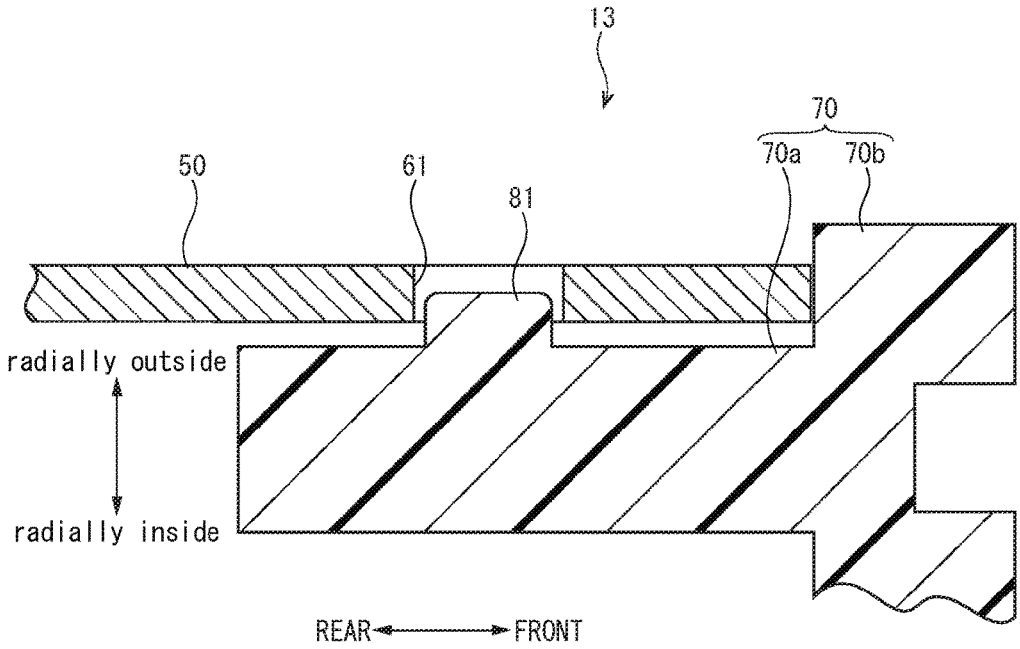
FIG. 7 is a sectional view taken along a line VII-VII in FIG. 6.
Figure 8:
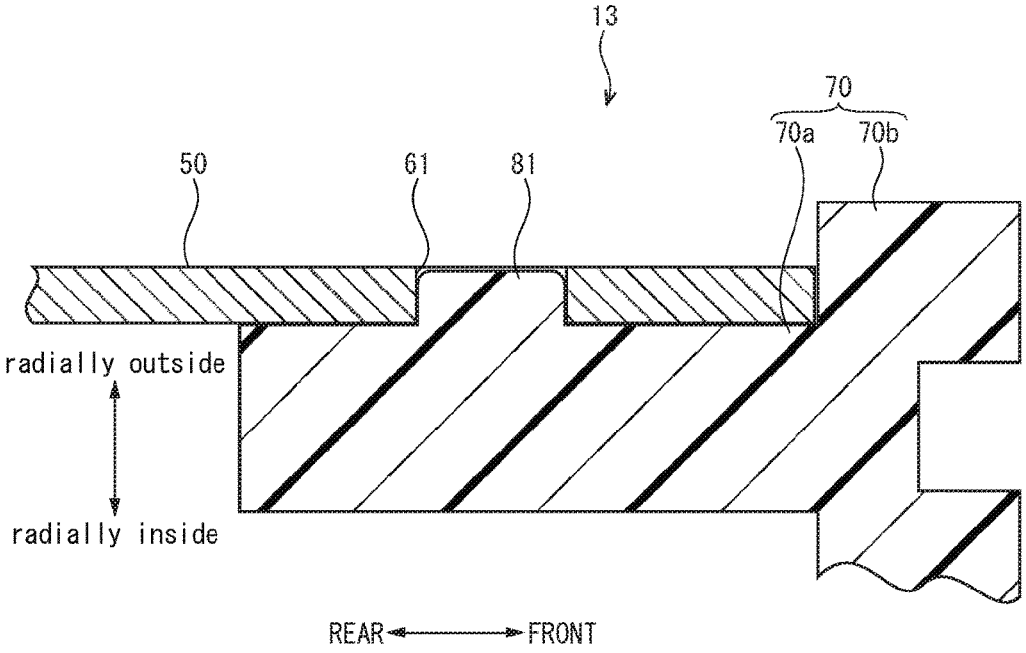
FIG. 8 is a sectional view illustrating a state in which the heat insulating bushing illustrated in FIG. 7 is thermally expanded.

Next, reference to FIGS. 4 through 8, the heating roller 50 and the heat insulating bushing 70 will be described. FIG. 4 is a perspective view illustrating the belt unit 41 of the fixing unit 13. FIG. 5 is a perspective view illustrating the heating roller 50 and the heat insulating bushing 70 of the fixing unit 13. FIG. 6 is a side view illustrating the heating roller 50, the heat insulating bushing 70 and a rotation detecting mechanism 90 of the fixing unit 13. FIG. 7 is a sectional view taken along a line VII-VII in FIG. 6. FIG. 8 is a sectional view illustrating a state in which the heat insulating bushing 70 is thermally expanded.

As described above, the heating roller 50, i.e., the rotating member, is heated by the IH coil 43*b* and is configured to rotate around the first rotational shaft 50*a*. As shown in FIG. 4, the two heat insulating bushings 70, i.e., heat insulating members, are attached at the both front and rear ends of the heating roller 50. It is noted that the heat insulating bushing 70 may be attached at least one of the both front and rear ends of the heating roller 50.

As shown in FIG. 5, the heating roller 50 is formed into the cylindrical shape whose both front and rear surfaces are opened (FIG. 5 indicates only the front side). The both front and rear ends of the heating roller 50 are provided with two keyways 60 and three engage holes 61, respectively. It is noted that the configurations of the both front and rear ends of the heating roller 50 are substantially the same, the following description will be made by noticing on the front end part of the heating roller 50.

The two keyways 60 are defined at positions (up and down in FIG. 5) facing in a radial direction of the heating roller 50. Each keyway 60 is cut approximately into a shape of U from the front end part of the heating roller 50 to a rear direction (axially center direction). A bent piece 60*a* bent radially inside is formed at one side in a circumferential direction of each keyway 60.

The three engage holes 61 are perforated through the heating roller 50 at certain intervals (equal intervals) in the circumferential direction at positions avoiding the two keyways 60. The three engage holes 61 are disposed on one and same circumference. Each engage hole 61 is a circular opening defined so as to penetrate through the heating roller 50 in the radial direction.

In succession, the two heat insulating bushings 70 are formed integrally by a resin material such as polyether ether ketone, respectively. Coefficients of thermal expansion of the respective heat insulating bushings 70 are set to be higher than that of the heating roller 50.

As shown in FIG. 5, the two heat insulating bushings 70 include a fitting part 70*a* and a gear part 70*b*, respectively (FIG. 5 indicates only the front side). It is noted that because the two heat insulating bushings 70 are almost same, the following description will be made by noticing on the front heat insulating bushing 70.

A shaft hole 70*c* is formed in an axial center part of the heat insulating bushing 70 (the fitting part 70*a*, the gear part 70*b*) to fix the first rotational shaft 50*a* (see FIG. 4). The first rotational shaft 50*a* is pivotally supported by the engage groove 46 of the fixed frame 44 (see FIG. 3). Because the heat insulating bushing 70 is provided between the heating roller 50 and the first rotational shaft 50*a*, the heat insulating bushing 70 cuts the heat otherwise transmitted from the heating roller 50 to the first rotational shaft 50*a* (the fixed frame 44).

The fitting part 70*a* is formed approximately into a cylindrical shape that can be fitted into the heating roller 50. That is, the fitting part 70*a* fits into the heating roller 50. The fitting part 70*a* includes two keys 80 and three engaging projections 81.

The two keys 80 are formed at positions radially facing with each other around the fitting part 70*a* (FIG. 5 indicates only upper side). Each key 80 projects for radially outside from an outer circumferential surface of the fitting part 70*a*. A slit 80*a* is concavely defined along the key 80 on the fitting part 70*a*.

The three engaging projections 81 are provided so as to project at equal intervals in the circumferential direction of the fitting part 70*a* at positions avoiding the two keys 80 (FIG. 5 illustrates only the two projections). Each engaging projection 81 is a columnar projection extending from the outer circumferential surface of the fitting part 70*a* to radially outside. An outer diameter of each engaging projection 81 is formed to be slightly smaller than an inner diameter of each engage hole 61.

When the fitting part 70*a* is fitted into the heating roller 50 from the front end part thereof as shown in FIG. 6, the two keys 80 fit with the corresponding keyways 60. The heat insulating bushing 70 can be positioned with respect to the heating roller 50 by fitting each key 80 of the heat insulating bushing 70 into each keyway 60 of the heating roller 50. It is noted that the bent piece 60*a* (see FIG. 5) of each keyway 60 enters the slit 80*a* concavely defined along the key 80.

As each key 80 is fitted into each keyway 60, the three engaging projections 81 fit into the corresponding engage holes 61. More specifically, each engaging projection 81 is loosely fitted into each engage hole 61 from radially inside in a state in which the heating roller 50 is not heated (during when the printer 1 is not operated) as shown in FIG. 7. That is, each engaging projection 81 is designed to have a gap (backlash) with each engage hole 61 and not be in pressure contact with the fixing belt 53 in the state when the heating roller 50 is cool. This arrangement makes it possible to prevent the fixing belt 53 from being damaged.

As shown in FIG. 5, the gear part 70*b* is sequentially connected at the front end part (outer side) of the fitting part 70*a*. The gear part 70*b* is formed approximately into a cylindrical shape having a same axial center with the fitting part 70*a*. The gear part 70*b* is formed to be larger than the fitting part 70*a* in terms of their diameters. A plurality of teeth 82 is arrayed in parallel in a circumferential direction of an outer peripheral surface of the gear part 70*b*. The gear part 70*b* is formed to transmit rotations of the heating roller 50 to the rotation detecting mechanism 90.

As shown in FIG. 6, the rotation detecting mechanism 90, i.e., an outside mechanism, includes a transmission gear 90*a*, a rotation detector 90*b* and sensor 90*c*. The transmission gear 90*a* is disposed so as to mesh with (the teeth 82 of) the gear part 70*b*. The rotation detector 90*b* is connected with the transmission gear 90*a* through the mechanism shaft 90*d* and is configured to be rotatable integrally with the transmission gear 90*a*. A plurality of concave and convex parts is arrayed in parallel in a circumferential direction of the rotation detector 90*b*. The sensor 90*c*, e.g., a photo-interrupter, includes a light emitting and receiving parts (both not shown) facing with each other with the rotation detector 90*b* between them. The sensor 90*c* is electrically connected with the controller.

The rotation of the heating roller 50 is transmitted to the transmission gear 90*a* through the heat insulating bushing 70 (the gear part 70*b*). The rotation detector 90*b* integrally rotating with the transmission gear 90*a* repeats cut-off and opening of an optical path from the light emitting part to the light receiving part of the sensor 90*c*. This arrangement makes it possible to judge whether or not the heating roller 50 is being rotated. For instance, if it is unable to detect the rotation of the heating roller 50 after starting to supply power to the IH coil 43*b*, the controller judges that the rotation is abnormal and stops to drive the fixing unit 13. As described above, each heat insulating bushing 70 for blocking the transmission of the heat also functions as a member for transmitting the rotation of the heating roller 50 to the rotation detecting mechanism 90. This arrangement makes it possible to simplify the structure of the fixing unit 13.

If the fixing unit 13 is driven here, the heating roller 50 is heated by the IH coil 43*b* and thermally expands. Along with the heating of the heating roller 50, the heat insulating bushing 70 is also heated and thermally expands. Because the coefficient of thermal expansion of the heat insulating bushing 70 is set to be higher than that of the heating roller 50, the heat insulating bushing 70 expands more than the heating roller 50. That is, the heat insulating bushing 70 is enlarged in the radial direction. When the heat insulating bushing 70 is heated by the IH coil 43*b* and thermally expands, an outer circumferential surface of the fitting part 70*a* (the heat insulating bushing 70) comes into close contact with an inner circumferential surface of the heating roller 50 (see FIG. 8). Accordingly, the fitting part 70*a* is put into a condition in which the fitting part 70*a* is press-fitted into the end part of the heating roller 50.

Still further, each engaging projection 81 thermally expands within each engage hole 61, and the play (backlash) between each engaging projection 81 and each engage hole 61 is eliminated (see FIG. 8). Accordingly, each engaging projection 81 is put into a condition in which each engaging projection 81 thermally expands and is press-fitted into each engage hole 61. In this case, the heat insulating bushing 70 is fixed to the heating roller 50 firmly. It is noted that each key 80 is formed so as not to project out of each keyway 60 to a surface side (radially outside) of the heating roller 50. In the same manner, each engaging projection 81 is formed so as not to project out of each engage hole 61 to the surface side of the heating roller 50. This arrangement makes it possible to prevent the fixing belt 53 from being damaged during when the heat insulating bushing 70 thermally expands.

According to the fixing unit 13 of the present embodiment described above, the heat insulating bushing 70 is unrotatably fixed to the heating roller 50 by fitting the three engaging projections 81 into the respective corresponding engage holes 61. This arrangement makes it possible to prevent the heat insulating bushing 70 and the heating roller 50 slip from each other in the circumferential direction (rotational direction). It is also possible to prevent noise from being generated otherwise caused by friction between the heat insulating bushing 70 and the heating roller 50. It is also possible to easily fix the heat insulating bushing 70 to the heating roller 50 just by fitting each engaging projection 81 to each engage hole 61. Still further, because the present embodiment adopts the configuration of physically preventing the slip by fitting each engaging projection 81 to each engage hole 61, it is possible to widen an option in selecting the material of the heat insulating bushing 70.

It is noted that it is preferable to set the coefficient of thermal expansion of the heat insulating bushing 70 to be more than ten times of that of the heating roller 50. Because a coefficient of thermal expansion of resin is around ten times of that of metal in general, it is possible to arbitrarily select the material of the heat insulating bushing 70 out of a large number of heat-resistant resin materials.

It is noted that while the three each engage holes 61 and engaging projections 81 are provided respectively in the circumferential direction at the predetermined intervals in the present embodiment described above, the present disclosure is not to limited to such configuration, and they may be three or more, respectively. Still further, the plurality of engage holes 61 (the engaging projections 81) may be disposed at intervals different from what described above.

It is also noted that the case of attaching the heat insulating bushing 70 to the heating roller 50, i.e., the rotating member, has been exemplified in the present embodiment described above, the present disclosure is not limited to such configuration. For instance, the heat insulating bushing 70 may be attached to the fixing roller 51 or the tension roller 52 as a rotating member.

It is noted that the method of wrapping the fixing belt 53 around the three rollers 50, 51 and 52 has been adopted in the fixing unit 13 of the present embodiment, the present disclosure is not also limited to such configuration. For instance, although not shown, a method of providing a fixing belt around one roller may be adopted in the fixing unit.

Still further, while the IH coil 43*b* has been adopted as the heat source in the fixing unit 13 of the present embodiment, the present disclosure is not also limited to such configuration. For instance, a halogen heater, a ceramic heater or the like may be adopted as a heat source.

Still further, the case in which the present disclosure is applied to the color printer 1 as one example has been described in the present embodiment, the present disclosure is not limited to such case, and the present disclosure is applicable also to a monochrome printer, a multi-function printer, a facsimile, or the like.

While the preferable embodiment and its modified example of the fixing unit and the image forming apparatus or the like of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A fixing unit, comprising:

a rotating member heated by a heat source and configured to rotate around a shaft; and a heat insulating member attached at an end of the rotating member;

wherein the rotating member includes three or more engage holes perforated at intervals in a circumferential direction thereof, and the heat insulating member includes three or more engaging projections fitting into the respective engage holes, wherein a coefficient of thermal expansion of the heat insulating member is set to be higher than a coefficient of thermal expansion of the rotating member, wherein the rotating member is formed into a cylindrical shape, the heat insulating member is formed to be fittable into the rotating member, the respective engaging projections are put into a condition in which the respective engaging projections are loosely fitted into the respective engage holes from radially inside in a state in which the rotating member is not heated, and the respective engaging projections are put into a condition in which the respective engaging projections are press-fitted into the respective engage holes from radially inside in a state in which the rotating member is heated.

2. The fixing unit according to claim 1, wherein the heat insulating member comprises:

a fitting part including the respective engaging projections and fitting into the rotating member; and a gear part sequentially connected to the fitting part and configured to transmit a rotation of the rotating member to an outside mechanism.

3. The fixing unit according to claim 1, wherein the rotating member includes a keyway cut from an end of the rotating member toward an axially center direction, and the heat insulating member includes a key fitting into the keyway.

4. The fixing unit according to claim 3, wherein the heat insulating member includes a slit concaved defined along the key, the rotating member includes a bent piece bent radially inside at one side in the circumferential direction of the keyway, and wherein the bent piece enters the slit in a state in which the heat insulating member is fitted into the rotating member.

5. An image forming apparatus comprising:

the fixing unit according to claim 1, the fixing unit being configured to fix a toner image on a recording medium.

6. The fixing unit according to claim 1, wherein the rotating member is formed of a metallic material, the heat insulating member is formed of a resin material, and the coefficient of thermal expansion of the heat insulating member is set to be higher than the coefficient of thermal expansion of the rotating member by ten times or more.

* * * * *